United States Patent [19]

Ikenoue et al.

[11] 4,125,403

[45] Nov. 14, 1978

[54] HEAT DEVELOPABLE LIGHT SENSITIVE MATERIAL

[75] Inventors: Shinpei Ikenoue; Harumi Katsuyama; Takao Masuda, all of, Asaka, Japan

[73] Assignee: Fuji Photo Film Co., Ltd., Minami-ashigara

[21] Appl. No.: 810,656

[22] Filed: Jun. 27, 1977

[30] Foreign Application Priority Data

Jun. 25, 1976 [JP] Japan ..... 57-75342

[51] Int. Cl.[2] ..... G03C 1/02; G03C 1/28; G03C 1/34

[52] U.S. Cl. ..... 96/114.1; 96/108; 96/109; 96/94 R

[58] Field of Search ..... 96/109, 107, 108, 104, 96/114.1, 67, 94 R

[56] References Cited

U.S. PATENT DOCUMENTS

| | | | |
|---|---|---|---|
| 2,057,764 | 10/1936 | Brunken | 96/109 X |
| 2,275,727 | 3/1942 | Carroll et al. | 96/107 X |
| 2,394,198 | 2/1946 | Mueller | 96/109 |
| 2,756,146 | 7/1956 | Levy | 96/107 |
| 2,938,609 | 5/1961 | Allen et al. | 96/107 |
| 3,047,393 | 7/1962 | Herz et al. | 96/109 |
| 3,144,336 | 8/1964 | Herz | 96/108 |
| 3,457,078 | 7/1969 | Riester | 96/104 |
| 3,645,739 | 2/1972 | Ohkubo et al. | 96/67 |
| 3,819,379 | 6/1974 | Ohyam et al. | 96/109 X |
| 3,951,660 | 4/1976 | Haggemann et al. | 96/67 |

*Primary Examiner*—Edward C. Kimlin
*Assistant Examiner*—Alfonso T. Suro Pico
*Attorney, Agent, or Firm*—Sughrue, Rothwell, Mion, Zinn and Macpeak

[57] ABSTRACT

A heat developable light sensitive material which comprises a support having therein or in one or more layers thereon (a) an organic silver salt, (b) a light sensitive silver halide or a component capable of producing a light sensitive silver halide and (c) a reducing agent and additionally contains (d) at least one phthalazinone and (e) at least one compound selected from benzoxazinediones and quinazolinediones in a molar ratio of the amount of the component (e) to that of the component (d) smaller than about 1:1 (i.e. molar ratio (e)/(d) 1) in at least one of the layers containing components (a) to (c), in a specific layer additionally provided on the support other than the layers containing components (a) to (c), or in the support to result in the production of images of a pure black tone and in improvements in shelf-life under high humidity and the developing speed.

11 Claims, No Drawings

HEAT DEVELOPABLE LIGHT SENSITIVE MATERIAL

BACKGROUND OF THE INVENTION

1. Field of the Invention

The present invention relates to a heat developable light sensitive material and more particularly, it is concerned with a heat developable light sensitive material which can not only be used to provide an image of a pure black tone but also show an improved shelf-life (which means the ability of the heat developable light sensitive material to retain those initial photographic characteristics possessed even after prolonged storage) and an increased speed of development.

2. Description of the Prior Art

Photography which uses silver halide has been carried out to a much greater extent, as compared with other photographic methods such as diazo photography, electrophotography and the like, because the former possesses superior photographic characteristics such as sensitivity, gradation, etc., than the latter. However, silver halide photography is time-consuming and requires a large amount of labor because several steps for processing the silver halide light sensitive material used therein are required; that is to say, the silver halide light sensitive material must be first subjected to an image wise-exposure and then, to a developmental processing with a developing solution, followed by stopping, fixation, washing and/or stabilization treatments with respective processing solutions therefor for the purposes of preventing of a rapid color change or a deterioration from occurring in the developed image area under the exposure to normal room illumination and of a blackening occurring in the non-developed white area (which is called background hereinafter). In addition, agents used therein adversely affect the human body when handled and further, rooms used for the above described processings, and the worker's hands and clothes as well, are stained with the agents used. Furthermore, the waste processing solutions, if discarded directly into a river, cause pollution problems. Therefore, it has been strongly desired to develop a method capable of processing highly sensitive silver halide photographic materials under dry conditions instead of the conventionally employed wet conditions using processing solutions, and capable of providing a processed image which is stable and that capable of reducing to a marked extent the color change occurring in the processed background through exposure to normal room illumination.

Many efforts have been made to solve these problems. For example, the addition of a 3-pyrazolidone type developing agent to a silver halide emulsion made it possible for the emulsion to be developed through the application of heat, as disclosed in German Patent Application (OLS) Nos. 1,123,203 and 1,174,157.

In addition, the combined addition of the above-described developing agent and a certain fixing agent suitable for silver halide to a silver halide emulsion has been proposed in German Patent Application (OLS) No. 1,003,578. However, it is impossible using these techniques to completely stabilize silver halide itself, which remains in the light sensitive material processed under dry conditions, against exposure to normal room illumination. Namely, a fixing process using dry conditions was not described in the above-described three German Patent Applications and further, in the method described in German Patent Application (OLS) 1,003,578, the developing agent (reducing agent) and the fixing agent present in the emulsion undergo an undesirable reaction upon storage, as would be expected. Therefore, these techniques appear to be rather impractical industrially.

In the art of making light sensitive materials capable of producig photographic images according to the dry process of the kind described above, the most successful photographic materials are the heat developable light sensitive materials as disclosed in U.S. Pat. Nos. 3,152,904 and 3,457,075; which utilize a composition containing, as essential components, the silver salt of an organic acid, a small amount of silver halide and a reducing agent. In this light sensitive system, the silver halide remaining in the light sensitive material after completion of development processing is allowed to simply change color through exposure to light without stabilizing it to light. Nevertheless, this system exhibits a satisfactory effect equivalent to other systems wherein the residual silver halide is subjected to a certain stabilizing treatment to light, since only a small amount of silver halide is incorporated therein and because, a large portion of the silver component is present in the form of a white or a pale yellow-colored organic silver salt which is so stable to light that it hardly blackens through exposure to light, and even if coloration does occur through a decomposition of the small amount of residual silver halide resulting from the light-exposure, the system is, on the whole, white or slighty colored light yellow and therefore, such a slight coloration is difficult to perceive by the human eye. The above-described light sensitive system can be used to produce an image according to the following mechanism where the system is heated to about 80° C and preferably, to 100° C, after the conclusion of image-exposure, the organic silver salt, which can act as an oxidizing agent, and the reducing agent (which are incorporated together into a light sensitive layer) undergo a redox reaction due to the inherent catalytic action of the small amount of exposed silver halide present in the vicinity thereof to result in a liberation of silver which quickly blackens the exposed area of the light sensitive layer and causes a clear contrast to the unexposed area thereof (background) to produce an image, although the system is inactive at ordinary temperatures (e.g., below about 70° C).

As another example of a heat developable light sensitive materials of this kind, mention may be made of those which are disclosed in Japanese Patent Application (OPI) No. 4728/71, U.S. Pat. No. 3,933,507 and Japanese Patent Publication No. 25498/74, wherein light sensitive complex salts prepared from silver salts and dyes are employed as a photo-catalyst instead of the above-described silver halides. Furthermore, the combined use of a highly light sensitive organic silver salt and a rather low light sensitive organic silver salt can provide desirable effects upon heat developable light sensitive materials, as disclosed in Japanese Patent Application (OPI) No. 8522/75.

Most of the above-described heat developable light sensitive materials which utilize organic silver salts as oxidizing agents only provide yellowish brown colored images. However, they can be modified by the addition of an appropriate color toning agent thereto to result in the production of images of a good black tone. In U.S. Pat. No. 3,457,075, phthalazinone is used independently as a color toning agent. However, the independent use of phthalazinone has the disadvantage of adversely affecting the shelf-life and particularly, under the condition of high humidity. Namely, a heat developable light sensitive material which has been stored a long time in an atmosphere of a humidity higher than about 80% R.H. and then is exposed to light and developed through the application of heat results in the production of a brown-colored image and also, in a reduction in the maximum density of the resulting image and in the sensitivity of the resulting material.

Moreover, a phthalazinone-containing heat developable light sensitive material has another disadvantage, since phthalazinone tends to sublime to a great extent and therefore, the processing device used becomes contaminated with sublimed phthalazinone as it is used repeatedly in order to process a number of sheets of a phthalazinone-containing heat developable light sensitive material. With the intention of preventing phthalazinone from subliming on the occasion of heat development, the use of phthalazinone derivatives of the kind which contain substituent groups at some positions of the condensed benzene ring instead of using an un-substituted phthalazinone is disclosed in Japanese Patent Application (OPI) No. 67132/75 (corresponding to U.S. Patent Application Ser. No. 515,375, filed Oct. 16,1974). Heat developable light sensitive materials utilizing the above-described phthalazinone derivatives have excellent sublimation prevention properties and shelf-life under ordinary conditions of storage, but have some problems to be improved which concern the shelf-life under high temperature and humidity conditions. Further, heat developable light sensitive materials containing other phthalazinone derivatives which have carbamoyl groups at the N-positions thereof are disclosed in U.S. Pat. No. 3,844,797, but they have the disadvantage of low developing speed.

On the other hand, examples of compounds which are known as a color toning agent, other than the above-described phthalazinones, are cyclic imides including substituted phthalimides, as disclosed in British Pat. No. 1,380,795; quinazolinones and pyrazoline-5-ones, as disclosed in U.S. Pat. No. 3,846,136; N-hydroxynaphthalimides, as disclosed in U.S. Pat. No. 3,782,941; mercapto compounds as disclosed in U.S. Pat. No. 3,832,186 and U.S. Pat. No. 3,881,938; phthalazinediones as disclosed in Japanese Patent Application (OPI) No. 116471/73 (corresponding to U.S. Patent Application Ser. No. 515,375, filed Oct. 16,1974); uracils, barbituric acid, saccharin, 5-nitrosaccharin, phthalic anhydride, sulfolane, 2-mercapto- benzoxazole, 2-hydroxybenzothiazole, 2-amino-6-methylbenzothiazole, 2-amino-4-(4-biphenyl)thiazole, imidazole, 2-hydroxybenzimidazole and N,N'-ethylenethiourea, as disclosed in British Pat. No. 1,462,016; and so on. However, these known color toning agents provide less satisfactory results, since the color toning function inherent therein is insufficient, they adversely affect the shelf-lie or they reduce the speed of heat development.

Further, benzoxazinediones and quinazolidinediones as disclosed in U.S. Pat. No. 3,951,660 can be also employed as a color toning agent, but they have the same disadvantages as the above-described phthalazinones have when they are used independently; that is to say, when they are used sufficient shelf-life under high humidity conditions is not obtained to cause a deterioration in the color tone of the image, a reduction in the maximum color density and the large decrease sensitivity. Furthermore, the benzoxazinediones and the quinazolidinediones have another disadvantage in that the developing speed attainable with a light sensitive material containing one of these compounds independently just after the preparation thereof is inferior to that of a light sensitive material containing a phthalazinone independently.

In addition, the combined use of a benzoxazinedione or of a quinazolidinedione with a commonly used toner compound (e.g., an unsubstituted phthalazinone, a phthalazinone derivative, phthalimide or a phthalimide derivative) is disclosed in U.S. Pat. No. 3,951,660. The disclosure therein is that the concentration of an assistant toner compound is preferably lower than that of the benzoxazinedione or quinazolidinedione, but the effects resulting from this combined use are not at all described.

As is apparent from the above descriptions, it has been difficult to achieve simultaneously the production of images of a pure black tone and other properties; that is to say, a prevention of sublimation of a color toning agent from occurring, an improvement in the shelf-life of a heat developable light sensitive material under high humidity conditions and an improvement in the heat developing speed of a heat developable light sensitive material.

SUMMARY OF THE INVENTION

Therefore, an object of the present invention is to provide a heat developable light sensitive material capable of producing an image of a pure black tone.

Another object of the present invention is to provide a heat developable light sensitive material in which the device used for heat development thereof is substantially free from contamination.

A further object of the present invention is to provide a heat developable light sensitive material having excellent shelf-life under conditions of high humidity.

A still further object of the present invention is to provide a heat developable light sensitive material which can be heat-developed with high speed.

The above-described objectives are attained with a heat developable light sensitive material containing at least (a) an organic silver salt, (b) a light-sensitive silver halide or a component capable of producing a light sensitive silver halide and (c) a reducing agent in one or more layers provided on a support, and further containing (d) at least one of a phthalazinone and (e) at least one compound selected from the group consisting of a benzoxazinedione and a quinazolidinedione in a molar ratio of the amount of the component (e) to that of the component (d) which is smaller than about 1:1, in at least one of these layers, in another layer other than these layers provided on a support, or in the support.

DETAILED DESCRIPTION OF THE INVENTION

In the present invention, component (d) may be used in an amount of about 0.1 to about 2 mole and preferably, about 0.3 to about 1 mole, per mole of the organic silver salt component (a).

Component (d) and component (e) are used in combination with a molar ratio (e) : (d) of smaller than about 1:1 (i.e., molar ratio of (e)/(d) $<1$) and preferably, ranging from about 0.001:1 to about 0.08:1 and more particularly, ranging from 0.01:1 to 0.5:1. In the present invention, component (e) is used in a small amount so that a toning effect is not observed if component (e) is not used in combination with component (d) (that is, component (e) is used alone). On the other hand, when component (e) is used in combination with component (d) in an amount above the above-described ratio, undesirable fog upon heat development occurs, while a satisfactory improvement in shelf-life cannot be obtained when it is used in combination with component (d) in an amount less than that within the above-described ratio.

Preferred phthalazinones which can be employed as component (d) in the present invention are represented by the following general formula (I):

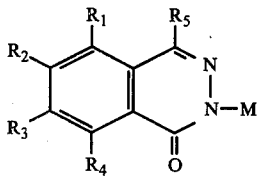

(I)

wherein $R_1$, $R_2$, $R_3$, $R_4$ and $R_5$, which may be the same or different each represents a hydrogen atom, a halogen atom, a hydroxy group, a nitro group, a $—NH_2$ group or a carbon-containing group which contains 1 to 20 carbon atoms, and which may contain an oxygen atom, a nitrogen atom, a sulfur atom, a halogen atom or the like atoms; and M represents a hydrogen atom, a univalent metal atom, a hydroxyalkyl group or a carbamoyl group having a substituent group containing 1 to 18 carbon atoms.

Examples of halogen atoms represented by $R_1$, $R_2$, $R_3$, $R_4$ or $R_5$ in the general formula (I) include a chlorine atom, a bromine atom and an iodine atom.

Examples of carbon-containing substituent groups represented by $R_1$, $R_2$, $R_3$, $R_4$ or $R_5$ include an alkyl group containing 1 to 4 carbon atoms, such as methyl, ethyl, propyl or the like; a haloalkyl group containing 1 to 4 carbon atoms, such as chloromethyl, bromoethyl, chloroethyl or the like; a hydroxyalkyl group containing 1 to 4 carbon atoms, such as hydroxymethyl, γ-hydroxypropyl or the like; an alkoxy group containing 1 to 4 carbon atoms, such as methoxy, ethoxy, butoxy or the like; a pyridyl group; an aryl group such as phenyl, naphthyl or the like; a substituted aryl group having an alkyl substituent group containing 1 to 4 carbon atoms, such as tolyl or the like; a substituted aryl group having a halogen substituent, such as chlorophenyl, bromophenyl or the like; an aralkyl group containing 7 to 12 carbon atoms, such as benzyl, phenethyl, p-methoxybenzyl or the like; an acyl group containing 2 to 4 carbon atoms, such as acetyl, propionyl or the like; an alkenyl group containing 3 to 6 carbon atoms, such as allyl or the like; a substituted alkyl group having a morpholino substituent in which the alkyl moiety thereof contains 1 to 4 carbon atoms, such as morpholinomethyl, morpholinoethyl, morpholinopropyl, morpholinobutyl or the like; a 2-substituted vinyl group such as β-styryl, 2-(3-pyridyl)vinylidene, 2-(2-pyridyl)-vinylidene or the like; an aminoalkyl group containing 1 to 4 carbon atoms, such as aminomethyl, aminoethyl, aminobutyl or the like; a di-substituted amino group having alkyl substituents containing 1 to 4 carbon atoms, such as dimethylamino, diethylamino or the like; a di-substituted aminoalkyl group having alkyl substituents containing 1 to 4 carbon atoms, such as dimethylaminomethyl, diethylaminomethyl or the like; and so on.

In particular, it is desirable for all of $R_1$, $R_2$, $R_3$ $R_4$ in the general formula (I) to be hydrogen atoms, because such compound (i.e., phthalazinone) contributes to an increase in the developing speed upon heating.

Examples of univalent metal atoms represented by M in the general formula (I) include lithium, sodium, potassium, silver and so on. Examples of hydroxyalkyl groups containing 1 to 5 carbon atoms represented by M include hydroxymethyl, β-hydroxyethyl, γ-hydroxypropyl and like groups. Of these groups, however, a hydroxymethyl group is the most preferred. The carbamoyl group represented by M which has a substituent group containing 1 to 18 carbon atoms is specifically illustrated by the following formula;

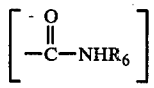

wherein $R_6$ represents a carbon-containing substituent group which has 1 to 17 carbon atoms and which, may contain an oxygen atom, a nitrogen atom, a sulfur atom or a halogen atom.

Preferred examples of carbon-containing substituent groups represented by $R_6$ include alkyl groups containing 1 to 18 carbon atoms such as methyl, ethyl, propyl, hexyl, dodecyl, octadecyl, cyclohexyl, cyclopentyl, etc.; substituted alkyl groups containing 1 to 12 carbon atoms which are substituted by an alkoxy group containing 1 to 4 carbon atoms, such as methoxyethyl, ethoxymethyl, etc.; alkenyl groups containing 3 to 6 carbon atoms such as allyl, etc.; aryl groups such as phenyl, naphthyl, etc.; substituted aryl groups with an acyl group such as benzoyl, etc.; substituted aryl groups having an alkyl substituent containing 1 to 4 carbon atoms, such as tolyl, p-ethylphenyl, etc.; substituted aryl groups having an alkoxy substituent containing 1 to 4 carbon atoms, such as methoxyphenyl, etc.; substituted aryl groups in which some hydrogen atoms are replaced by halogen atoms, such as p-chlorophenyl, 1-bromo-2-naphthyl, etc.; substituted aryl groups having an aryl substituent containing 6 to 10 carbon atoms, such as biphenyl etc.; and so on.

A hydrogen atom or a univalent metal atom is, in particular, preferred as $R_6$, since the corresponding phthalazinone derivatives contribute more efficiently to increasing the developing speed upon heating.

Specific and preferred examples of phthalazinones which may be employed as conponent (d) are illustrated below:

1. Phthalazinone,
2. 4-Methylphthalazinone,
3. 4-Phenylphthalazinone,
4. 4-(1-Naphthyl)phthalazinone,
5. 4-(2-Naphthyl)phthalazinone,
6. 4-Hydroxymethylphthalazinone,
7. 4-Chlorophthalazinone,
8. 4-(p-Chlorophenyl)phthalazinone,
9. 4-(p-Pyridino)phthalazinone,
10. 4-Methoxyphthalazinone,
11. 4-β-Styrylphthalazinone,
12. 4-Dimethylaminomethylphthalazinone,
13. 4-Morpholinomethylphthalazinone,
14. 4-(p-Methoxybenzyl)phthalazinone,
15. 4-(Benzylidenehydrazino)phthalazinone,
16. 4-(p-Dimethylaminophenyl)phthalazinone,
17. 4-Benzylphthalazinone,
18. 6-Chlorophthalazinone,
19. 5,7-Dimethoxyphthalazinone, 20. 8-Methylphthalazinone,
21. 6-Bromophthalazinone,
22. 8-t-Butylphthalazinone,
23. 5-Nitrophthalazinone,
24. 8-Aminophthalazinone,
25. 8-Hydroxyphthalazinone,
26. Phthalazinone,
27. Phthalazinone,
28. Phthalazinone,
29.

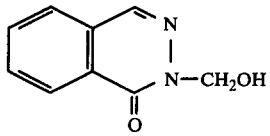

30.

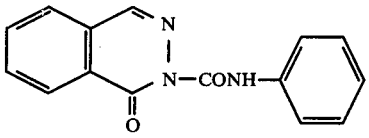

31.

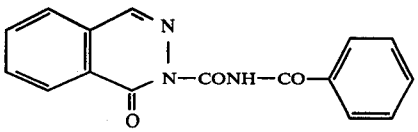

32.

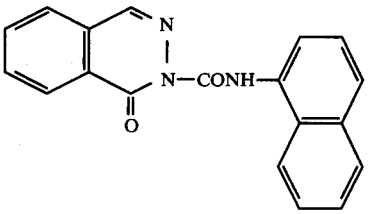

33.

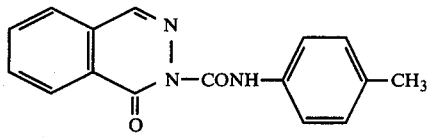

34.

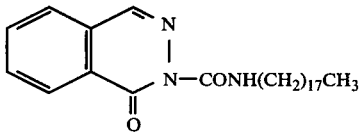

35.

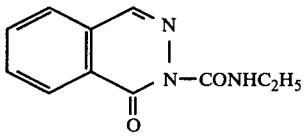

36.

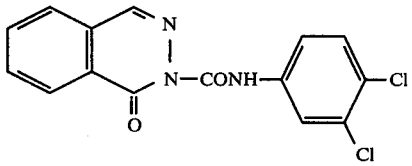

37.

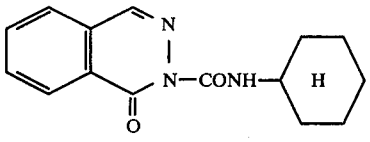

As for the benzoxazinediones or the quinazolinediones corresponding to component (e), those compounds represented by the following general formula (II) are preferred:

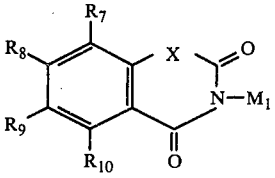

(II)

wherein $R_7$, $R_8$, $R_9$ and $R_{10}$, which may be the same or different, each represents a hydrogen atom, a halogen atom, a hydroxy group, a nitro group, $—NH_2$ or a carbon-containing substituent group containing 1 to 20 carbon atoms. The carbon-containing substituent group described above for $R_7$, $R_8$, $R_9$ and $R_{10}$ may contain an oxygen atom, a nitrogen atom, a sulfur atom, a halogen atom or the like. X represents an oxygen atom or a $>N\text{-}R_{11}$ group, wherein $R_{11}$ represents a carbon-containing substituent group which contains 1 to 20 carbon atoms and may contain an oxygen atom, a nitrogen atom, a sulfur atom, a halogen atom or the like.

$M_1$ in the general formula (II) represents a hydrogen atom, a hydroxymethyl group or a univalent metal atom.

Further in the general formula (II) $R_7$ and $R_8$, $R_8$ and $R_9$, or $R_9$ and $R_{10}$ may, further, combine and form an aromatic ring by condensing with each other.

A chlorine atom, a bromine atom or an iodine atom is preferred as the halogen atom as described above.

Specific examples of carbon-containing substituent groups represented by $R_7$, $R_8$, $R_9$, $R_{10}$ and $R_{11}$ include alkyl groups containing 1 to 4 carbon atoms, such as methyl, ethyl, propyl, etc.; haloalkyl groups containing 1 to 4 carbon atoms, such as chloromethyl, $\beta$-bromoethyl etc.; hydroxyalkyl groups containing 1 to 4 carbon atoms, such as hydroxymethyl, $\gamma$-hydroxypropyl, etc.; alkoxy groups containing 1 to 4 carbon atoms, such as methoxy, ethoxy, butoxy, etc.; cycloalkyl groups containing 5 to 12 carbon atoms, such as cyclopentyl, cyclohexyl, etc.; alkyl substituted amino groups containing 1 to 4 carbon atoms, such as dimethylamino, diethylamino, etc.; acyl groups containing 2 to 4 carbon atoms, such as acetyl, propionyl, etc.; alkenyl groups containing 3 to 6 carbon atoms, such as allyl, etc.; alkylthio groups containing 1 to 4 carbon atoms, such as methylthio, ethylthio, etc.; and so on.

Preferred examples of univalent metal atoms represented by $M_1$ in the general formula (II) include lithium, sodium, potassium, rubidium and cesium atoms.

Preferred examples of aromatic rings which may be formed by the combination of $R_7$ and $R_8$, $R_8$ and $R_9$, or $R_9$ and $R_{10}$ include a benzene ring and a naphthalene ring.

As the carbon-containing substituent group represented by $R_{11}$, alkyl groups containing 1 to 4 carbon atoms are particularly preferred.

Specific examples of compounds for component (e) are illustrated below:

(1)

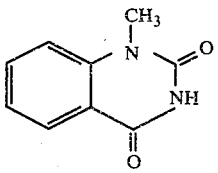

-continued
(2)
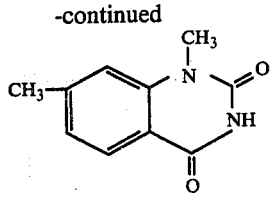
(3)
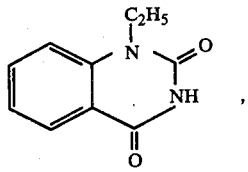
(4)
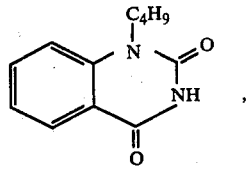
(5)
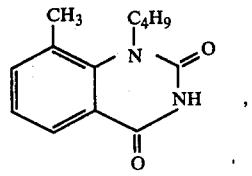
(6)
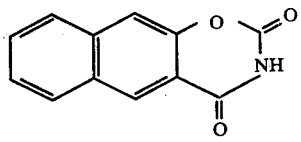
(7)
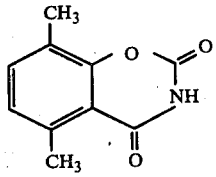
(8)
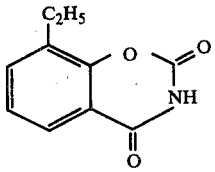
(9)
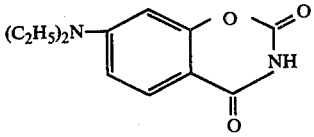
(10)
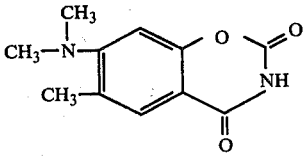
(11)
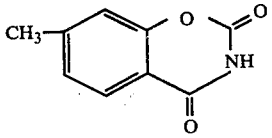
(12)
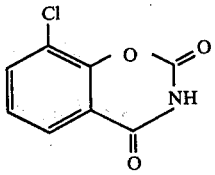
-continued
(13)
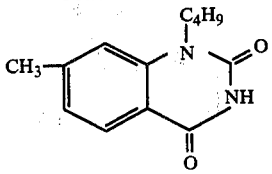
(14)
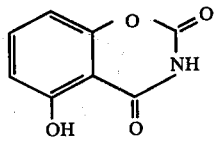
(15)
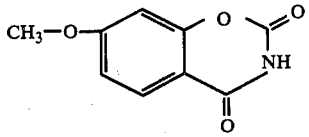
(16)
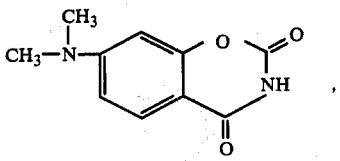
(17)
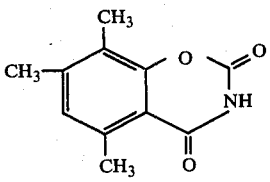
(18)
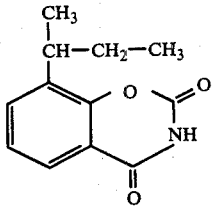
(19)
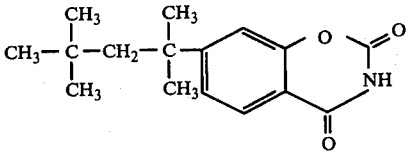
(20)
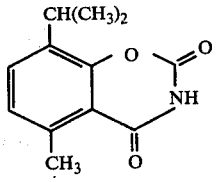
(21)
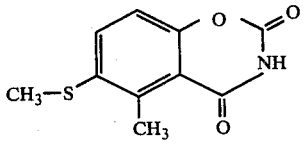
(22)
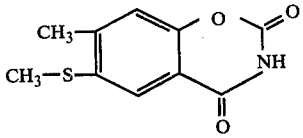
(23)
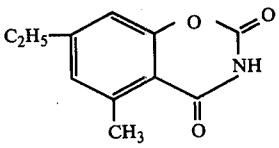

-continued
(24)
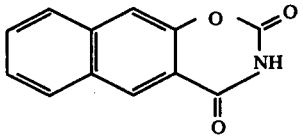
(25)
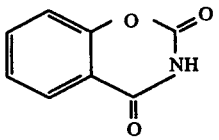
(26)
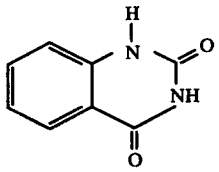
(27)
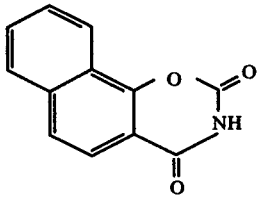
(28)
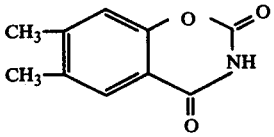
(29)
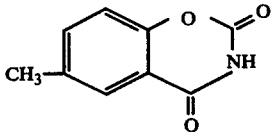
(30)
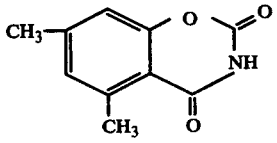
(31)
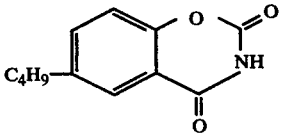
(32)
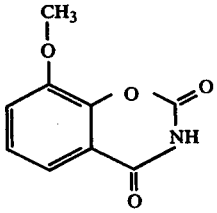
(33)
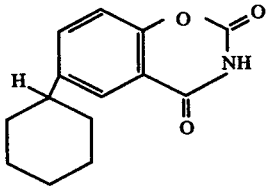
(34)
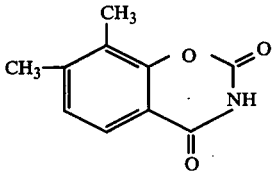
(35)
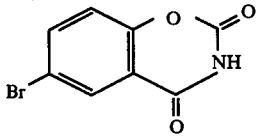
(36)
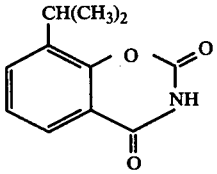
(37)
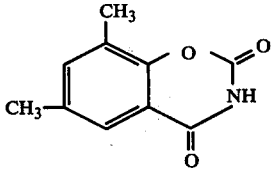
(38)
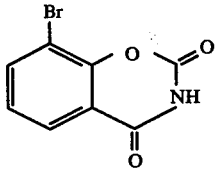
(39)
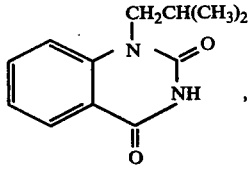
(40)
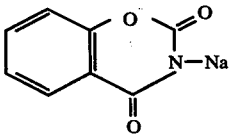
(41)
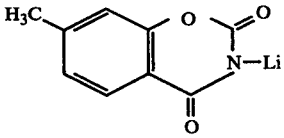
(42)
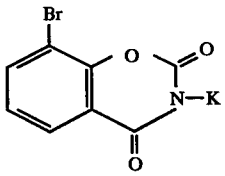
(43)
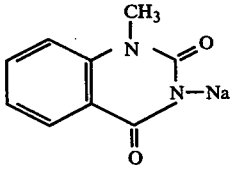
(44)
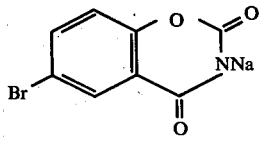

-continued (45)

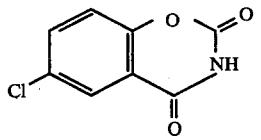

The above-described components (d) and (e) each can be incorporated into the support, in a back layer on the support, in a subbing layer provided on the surface of the support, in a light sensitive layer provided on the support or in a finally coated layer provided on a light sensitive layer.

In the present invention, it is preferable to introduce component (d) and the component (e) into a heat developable light sensitive material upon the preparation of the heat developable light sensitive material, but component (d) and component (e) can be also introduced into the heat developable light sensitive material by coating a solution containing both component (d) and component (e) on the material after preparation but prior to heat development.

More preferably, component (d) and component (e) are added to the mixture prepared from component (a) comprising the organic silver salt and component (b) comprising the light sensitive silver halide or the component capable of producing a light sensitive silver halide. This procedure may be achieved by adding component (d) and component (e) in the form of solid powders or in a form of a solution or a dispersion prepared by dissolving or dispersing component (d) and component (e) into an appropriate liquid (e.g., water, methanol, ethanol, acetone, methyl ethyl ketone, cyclohexane, dioxane, toluene, benzene, ethyl acetate, tricresyl phosphate, methyl Cellosolve, dimethylformamide and so on) to the mixture of component (a) and component (b).

Examples of organic silver salts for component (a) which may be used in the present invention are moderately stable, white or light yellow-colored silver salts and they can form a silver-image by reacting with the reducing agent component (c) in the presence of the exposed silver halides when heated at a temperature higher than about 80° C and preferably, higher than 100° C. Examples of such organic silver salts, include silver salts of particular organic compounds containing an imino group, a mercapto group, a thione group or a carboxyl group. Specific examples of these compounds are illustrated below:

1. Silver salts of imino group-containing organic compounds as disclosed in Japanese Patent Application (OPI) Nos. 91214/74, 28221/73 and 91215/74; U.S. Pat. Nos. 3,152,904 and 3,457,075; and so on (e.g., silver saccharin, silver benzotriazole, silver N-phthalimide and so on).
2. Silver salts of mercapto group- or thione group-containing organic compounds as disclosed in Japanese Patent Application (OPI) Nos. 52626/74 and 10039/74, and so on (e.g., silver salts of 2-mercaptobenzoxazole, 3-(2-carboxyethyl)-1-phenyl-1,3,4-triazoline-2-thione and the like).
3. Silver salts of carboxyl group-containing organic compounds as disclosed in U.S. Pat. Nos. 3,457,075; 3,330,663 and 3,667,958; Japanese Patent Publication Nos. 49498/74 and 18808/74: Japanese Patent Application (OPI) Nos. 6077/71, 97523/73, 10282/72, 1238/72 and 4728/71: German Patent Application (OLS) No. 2,308,766: and so on (e.g., silver caprate, silver laurate, silver myristate, silver palmitate, silver stearate, silver behenate, silver maleate, silver fumarate, silver tartarate, silver furoinate, silver linolate, silver oleate, silver hydroxystearate, silver adipate, silver sebacate, silver succinate, silver acetate, silver butyrate, silver camphorate and other silver salts of aliphatic carboxylic acids; and silver salts of aromatic carboxylic acids such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, silver salt of 4'-n-octadecyloxydiphenyl-4-carboxylic acid and the like).
4. Silver sulfonates (e.g., silver ethanesulfonate, silver 1-propanesulfonate and the like), silver sulfinates (e.g., silver p-toluenesulfinate and the like) and silver salts of tetrazaindenes as disclosed in British Patent No. 1,230,624 and Japanese Patent Application (OPI) No. 89720/73.

Of the above-described organic silver salts, more suitable salts for the component (a) in the case of using silver halides (or silver-dye light sensitive complex salts as hereinafter described) as a photo-catalyst are organic silver salts which are comparatively stable to light. Specific examples of such organic silver salts include silver salts of fatty acids containing more than 10 carbon atoms and more particularly, from 16 to 41 carbon atoms (such as silver palmitate, silver stearate, silver behenate and like silver salts of fatty acids containing an even number of carbon atoms, or $CH_3(CH_2)_{21}COOAg$, $CH_3(CH_2)_{27}COOAg$ and like silver salts of fatty acids containing an odd number of carbon atoms).

Various methods for preparing the above-described organic silver salts are known, and they are described in detail in, for example, U.S. Pat. Nos. 3,457,075; 3,458,544; 3,700,458 and 3,839,049: British Pat. Nos. 1,405,867 and 1,173,426: Japanese Patent Application (OPI) No. 22431/76: and Japanese Patent Application No. 45997/75. A summary of these methods is given below. That is to say, the organic silver salt can be prepared by mixing a liquid A wherein an organic silver salt-forming agent (e.g., imino compounds, carboxylic acids, mercapto compounds or the salts thereof) is dissolved in or dispersed into an appropriate solvent (e.g., water, aliphatic hydrocarbons, esters, ketones, halogenated hydrocarbons, ethers, aromatic hydrocarbons, alcohols and oils) with a liquid B wherein a silver salt capable of producing an organic silver salt (e.g., silver nitrate, silver trifluoroacetate, silver tetrafluoroborate and silver perchlorate) is dissolved in or dispersed into an appropriate solvent (e.g., water, alcohols, acid amides, amines, aqueous ammonia, ketones, acetonitrile, dimethylsulfoxide, aromatic hydrocarbons, pyridine and aliphatic hydrocarbons).

Specific examples of the above-described solvents include toluene, xylene, water, cyclohexane, cyclohexene, dodecene, pentane, hexane, heptane, butyl acetate, amyl acetate, pentyl acetate, tricresyl phosphate, castor oil, methyl alcohol, ethyl alcohol, propyl alcohol, butyl alcohol, acetone, dioxane, methyl ethyl ketone, methyl isobutyl ketone, methylene chloride, dibutyl phthalate, dimethylformamide, ammonia, acetonitrile and so on. However, suitable solvents which can be used are not intended to be construed as being limited to these examples set forth above.

The organic silver salt-forming reaction can be carried out at a temperature within the range of about −80° C to about 100° C and preferably, of about −20° C to about 70° C. The time required for the reaction is within the range of about 0.01 second to about 150 hours and preferably, of about 0.1 second to about 72 hours. Suitable pressures at which the reaction can be conducted range from about $10^{-2}$ mmHg to about 300 atmospheres and preferably, atmospheric pressure. A solution or a dispersion ranging in concentration from about $10^{-2}$% by weight to about $10^{2}$% by weight and generally, from about 1% by weight to about 50% by weight, may be employed in both cases of the liquid A and the liquid B.

Moreover, ultrasonic waves may be employed during the preparation of the organic silver salt, as disclosed in British Pat. No. 1,408,123.

In addition, polymers, metal-containing compounds and/or surface active agents may be present with the above-described organic silver salt-forming components at the time of preparation thereof with the intention of controlling the grain form of the organic silver salt, the grain size thereof and/or the photographic characteristics such as stability to light, stability to heat, sensitivity to light, fog and so on. Examples of such polymers include polyvinyl butyral as disclosed in U.S. Pat. No. 3,700,458 and Japanese Patent Application OPI No. 57111/77. Examples of metals present in such metal-containing compounds, include mercury, lead, chromium, cobalt and rhodium, as disclosed in British Patent No. 1,378,734; Japanese Patent Application (OPI) No. 22430/76, Japanese Patent Application (OPI) No. 116024/75 and Japanese Patent Application (OPI) No. 134421/75. In addition to these metals, manganese, nickel, iron and cerium can be also employed. The surface active agent and the polymer each may be employed in an amount ranging from about 0.1 to about 1000 g and preferably, from about 1 to about 500 g, per mole of organic silver salt. The metal-containing compound may be employed in an amount ranging from about $10^{-6}$ mole to $10^{-1}$ mole per mole of organic silver salt and ranging from about $10^{-5}$ mole to $10^{-2}$ mole per mole of silver halide.

The grain size of the thus obtained organic silver salt should be controlled to within the range of about 10 microns to about 0.01 micron and preferably, of about 5 microns to about 0.1 micron, measured as a length.

Component (b) of the present invention provides light-sensitivity to the heat developable light sensitive material and acts as the catalyst accelerating the redox image-forming reaction which takes place between component (a) and component (c).

Preferred examples of component (b) which can be used as a photo-catalyst in the present invention include silver chloride, silver bromide, silver iodide, silver chlorobromoiodide, silver chlorobromide, silver chloroiodide, silver iodobromide and mixtures thereof. Each of these silver halides is effective when used in an amount ranging from about 0.001 mole to about 0.5 mole and preferably, from about 0.01 mole to about 0.3 mole, per mole of the organic silver salt. A preferred grain size of the silver halide ranges from about 2 microns to about 0.001 micron and particularly, about 0.5 micron to about 0.01 micron, measured as a length. The light sensitive silver halide can be produced in an emulsion form using any methods known in the photographic art such as a single jet method, a double jet method and the like. Examples of such emulsions include a Lipmann emulsion, an ammonia process emulsion, emulsions ripened with a thiocyanate or a thioether and so on. The thus previously prepared light sensitive silver halide is admixed with the redox composition comprising component (a) and component (c). This procedure is described in U.S. Pat. No. 3,152,904. The organic silver salt and the reducing agent using this method as described in U.S. Pat. No. 3,152,904, however, are not in satisfactory contact each other and therefore, sufficient sensitivity is not attained. Accordingly, various attempts have been made in order to allow the silver halide grains to more closely contact the organic silver salt. One attempt is the introduction of a surface active agent thereinto, as disclosed in, for example, U.S. Pat. No. 3,761,273 and Japanese Patent Application (OPI) Nos. 32926/75 and 32928/75. Another attempt comprises mixing a silver halide prepared in a polymer medium with the organic silver salt, as disclosed in, for example, U.S. Pat. Nos. 3,706,565; 3,706,564 and 3,713,833: and British Pat. No. 1,362,970. A further attempt comprises the enzymatic decomposition of a silver halide emulsion and a mixing of the resulting decomposition product with the organic silver salt. Furthermore, the silver halide used in the present invention can be prepared substantially simultaneously with the production of the organic silver salt, as disclosed in Japanese Patent Application (OPI) No. 17216/75. Still another method comprises conversion of a certain portion of the organic silver salt into a light sensitive silver halide by allowing a light sensitive silver halide-forming component (as hereinafter described) to act upon a solution or a dispersion of the organic silver salt which was previously prepared, or upon a sheet material containing the organic silver salt thereon. The thus prepared silver halide effectively contacts the organic silver salt and, therefore, exhibits desirable effects, as disclosed in U.S. Pat. No. 3,457,075.

On the other hand, all compounds capable of producing silver halides by reacting with organic silver salts may be used as a light sensitive silver halide-forming component. Which compounds can be used as a light sensitive silver halide-forming component can be easily determined. That is to say, determination as to effectiveness can be made by examining using X-ray diffraction techniques whether diffraction peaks characteristic of silver halides appear when a sample prepared by allowing the compound to be examined to act upon the organic silver salt and optionally, by heating the reaction product.

Preferred conditions for producing the silver halide are illustrated in detail in the following. A suitable reaction temperature is within the range of about −80° C to about 100° C and more preferably, of about −20° C to about 70° C. The time required for the completion of the reaction is within the range of about 0.01 second to about 150 hours and particularly, within the range of about 0.1 second to about 72 hours. A suitable pressure of the reaction system can range from about $10^{-2}$ mmHg to about 300 atmospheres and preferably, is atmospheric pressure.

Examples of suitable components capable of producing light sensitive silver halides include inorganic halides, halogen-containing metal complex salts, onium halides, halogenated hydrocarbons, N-halo compounds and other halogen-containing compounds. Specific examples of these compounds are described in detail in Japanese Patent Application (OPI) No. 22431/76; U.S. Pat. No. 3,457,075; Japanese Patent Application (OPI) No. 78316/75; Japanese Patent Application (OPI) No. 115027/75 and Japanese Patent Application (OPI) No. 9813/76. Specific examples of these compounds are illustrated below:

1. Inorganic Halides: halides represented by the general formula: $M_2X^1_n$ wherein $M_2$ represents H, $NH_4$ or a metal atom described hereinafter, $X^1$ represents Cl, Br or I, and n represents 1 when $M_2$ represents H or $NH_4$, while n equals the valence of the metal atom when $M_2$ represents a metal atom, with examples of metal atoms including lithium, sodium, potassium, rubidium, cesium, copper, gold, beryllium, magnesium, calcium, strontium, barium, zinc, cadmium, mercury, aluminum, gallium, indium, lanthanum, ruthenium, thallium, germanium, tin, lead, antimony, bismuth, chromium, molybdenum, tungsten, manganese, rhenium, iron, cobalt, nickel, rhodium, palladium, osmium, iridium, platinum, cerium and so on.
2. Halogen-containing Metal Complex Salts: e.g., $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RhCl_6$, $(NH_4)_3RhBr_6$ and the like.
3. Onium Halides: e.g., quaternary ammonium halides such as trimethylphenylammonium bromide, cetylethyldimethylammonium bromide, trimethylbenzylammonium bromide, etc.; quaternary phosphonium halides such as tetraethylphosphonium bromide, etc.; tertiary sulfonium halides such as trimethylsulfonium iodide, etc.; and so on.
4. Halogenated Hydrocarbons: e.g., iodoform, bromoform, carbon tetrabromide, 2-bromo-2-methylpropane, etc.
5. N-Halo compounds: e.g., N-chlorosuccinimide, N-bromosuccinimide, N-bromophthalimide, N-bromoacetamide, N-iodosuccinimide, N-bronophthalazone, N-bromooxazoline, N-chlorophthalazone, N-bromoacetoanilide, N,N-dibromobenzenesulfonamide, N-bromo-N-methylbenzenesulfonamide, 1,3-dibromo-4,4-dimethylhydantoin, trichloroisocyanuric acid and so on.
6. Other Halogen-containing compounds: triphenylmethyl chloride, triphenylmethyl bromide, 2-bromobutyric acid, 2-bromoethanol, dichlorobenzophenone, triphenyl bromide and so on.

The silver halide-forming components as described above may be used individually or as a combination thereof. The silver halide-forming component is effective when used in an amount ranging from about 0.001 mole to about 0.5 mole and preferably, from about 0.01 mole to about 0.3 mole, per mole of the organic silver salt used as component (a). Addition of an amount of the silver halide-forming component less than the above-described lower limit will result in a reduction in sensitivity, while use of an excess amount will increase the color change due to light (undesirable coloration occurring in the background when the finished light sensitive materials are allowed to stand as they are exposed to normal room illumination).

The silver halide prepared by any method can be sensitized with sulfur-containing compounds, gold compounds, platinum compounds, palladium compounds, silver compounds, tin compounds or a combination thereof, as disclosed in, for example, Japanese Patent Application OPI Nos. 41519/76, 49023/76, 69628/76, 88216/76, 120715/76, and 4821/77.

Improvements in the photographic characteristics similar to the above can be attained by application of the flocculation process usually employed in the art of gelatin silver halide emulsion-making, wherein silver halide is prepared in presence of some portions of a binder and the resulting silver salt is precipitated using a centrifuge, followed by a redispersion of the resulting precipitate into the remaining protions of the binder. On redispersion, nitric acid, ferricyanate, thiocyanates, thiosulfates, benzotriazoles, tetrazainedenes, mercapto compounds, thione compounds, iodides and/or heavy metal salts such as rhodium salts may also be present with the intention of changing the photographic characteristics.

Other photo-catalysts can be also employed instead of silver halides. For example, light sensitive complexes prepared from silver salts and dyes can be used as a photo-catalyst, as disclosed in Japanese Patent Publication No. 25498/74, Japanese Patent Application (OPI) No. 4728/71 and Japanese Patent Application (OPI) No. 28221/73; and the combined use of a highly light sensitive organic silver salt and a low light sensitive organic silver salt can be utilized, as disclosed in Japanese Patent Application (OPI) No. 8522/75.. In addition, metal diazosulfonate salts as disclosed in U.S. Pat. No. 3,152,904; and sulfinates can be also used as a photo-catalyst. Further, photo-conductive materials such as zinc oxide, titanium oxides, etc., can also be utilized. When highly sensitive heat developable light sensitive materials are required, the most suitable photo-catalyst to be employed therein is silver halide.

Moreover, some kinds of optical sensitizing dyes which have been said to be effective for gelatin silver halide emulsions can also be employed in the heat developable light sensitive materials of the present invention. Specific examples of optical sensitizing dyes which may be effectively employed in the present invention include cyanine, merocyanine, rhodacyanine, complex(trinuclear or tetra-nuclear) cyanine or merocyanine, holopolarcyanine, styryl, hemicyanine, oxonol and hemioxonol xanthene series dyes. Of the cyanine dyes, those which contain a basic nucleus such as a thiazoline nucleus, an oxazoline nucleus, a pyrroline nucleus, a pyridine nucleus, an oxazole nucleus, a thiazole nucleus, a selenazole nucleus or an imidazole nucleus are more preferable. Imino group- or carboxyl group-containing cyanine dyes are particularly effective. Merocyanine dyes may have an acidic nucleus such as a thiohydantion nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus, in addition to the above-described basic nuclei. In particular, imino group- or carboxyl group-containing merocyanine dyes are effective for use.

Specific examples of sensitizing dyes which are particularly useful for the heat developable light sensitive materials of the present invention, include specific merocyanine dyes containing a rhodanine nucleus, a thiohydantoin nucleus or a 2-thio-2,4-oxazolidinedione nucleus, as disclosed in U.S. Pat. No. 3,761,279 and Japanese Patent Application (OPI) Nos. 105127/75 and 104637/75.

In addition to the above-described sensitizing dyes, trinuclear merocyanine dyes as disclosed in U.S. Pat. No. 3,719,495; the sensitizing dyes mainly used for silver iodide as disclosed in Japanese Patent Application (OPI) No. 17719/74; styrylquinone series dyes as disclosed in British Pat. No. 1,409,009; rhodacyanine dyes as disclosed in U.S. Pat. No. 3,877,943; acidic dyes such as 2',2'-dichlorofluorescene dyes, as disclosed in Japanese Patent Application (OPI) Nos. 96717/74 and 102328/74; and British Pat. No. 1,417,382; and merocyanine dyes as disclosed in Japanese Patent Application (OPI) No. 27924/76 and Japanese Patent Application No. 101680/75; can be similary employed in the present invention.

Each of these sensitizing dyes is effective when used in an amount ranging from about $10^{-4}$ mole to about 1 mole per mole of silver halide or silver halide-forming component of component (b).

Suitable reducing agents which can be employed as component (c) in the present invention must have the ability to reduce the organic silver salt (component (a)) upon heating in the presence of a photo-catalyst and preferably, in the presence of exposed silver halide. Which reducing agent is to be used of such reducing agents is, in practice, determined by which organic silver salt is used in combination therewith.

Preferred examples of reducing agents include mono-, bis- tris- and tetrakis-phenols, mono- and bis-naphthols, di- and poly-hydroxynaphthalenes, di- and poly-hydroxybenzenes, hydroxymonoethers, ascorbic acids, 3-pyrazolidones, pyrazolines, pyrazolones, reducing saccharides, phenylenediamines, hydroxylamines, reductones, hydroxaminic acids, hydrazides, amidoximes, N-hydro oxyureas and so on. Specific examples of these reducing agents are described in detail in Japanese Patent Application (OPI) No. 22431/76, U.S. Pat. Nos. 3,615,533; 3,679,426; 3,627,904; 3,751,252; 3,751,255; 3,782,949; 3,801,321; 3,794,488 and 3,893,863: Belgian Pat. No. 786,086; U.S. Pat. Nos. 3,770,488; 3,819,382; 3,773,512; 3,928,686; 3,827,889; 3,839,048 and 3,887,378: Japanese Patent Application (OPI) Nos. 15541/75 and 36143/75: Japanese Patent Application (OPI) Nos. 36110/75, 116023/75, 147711/75 and 23721/76: Japanese Patent Application (OPI) Nos. 32324/76 and 51933/76 and so on.

Of these compounds, polyphenols, sulfoamidophenols and naphthols are particularly preferred.

Preferred examples of polyphenols include 2,4-dialkyl substituted ortho-bisphenols, 2,6-disubstituted para-bisphenols and mixtures thereof. Specific examples, of these polyphenols are 1,1-bis(2-hydroxy-3,5-dimethylphenyl)-3,5,5,-trimethylhexane; 1,1-bis(2-hydroxy-3-t-butyl-5-methylphenyl)methane; 1,1,-bis(2-hydroxy-3,5-di-t-butylphenyl)methane; 2,6-methylbis-(2-hydroxy-3-t-butyl-5-methylphenyl)-4-methylphenol; 6,6'-benzylidene-bis(2,4-di-t-butylphenol); 6,6'-benzylidene-bis(2-t-butyl-4-methylphenol); 6,6'-benzylidene-bis(2,4-dimethylphenol); 1,1-bis(2-hydroxy-3,5-dimethylphenyl)-2-methyl-propane; 1,1,5,5-tetrakis-(2-hydroxy-3,5-dimethylphenyl)-2,4-ethylpentane; 2,2-bis(4-hydroxy-3,5-dimethylphenyl)propane; 2,2-bis(4-hydroxy-3-methyl-5-t-butylphenyl)propane; 2,2-bis(4-hydroxy-3,5-di-t-butylphenyl)propane and so on.

Preferred examples of naphthols include 2,2'-dihydroxy1,1'-binaphthyl; 6,6'-dibromo-2,2'-dihydroxy-1,1'-binaphthyl; 6,6'-dinitro-2,2'-dihydroxy-1,1,'-binaphthyl; bis(2-hydroxy-1-naphthyl)methane; 4,4'-dimethoxy-1,1'-dihydroxy-2,2'-binaphthyl and so on.

In addition, preferred examples of sulfonamidophenols are 4-benzenesulfonamidophenol; 2-benzenesulfonamidophenol; 2,6-dichloro-4-benzenesulfonamidophenol and so on. In addition to these examples, more specific examples are disclosed in Japanes Patent Application (OPI) Nos. 22431/76, 36110/75, 116023/75, 14711/75 and 23721/76; Japanese Patent Application (OPI) Nos. 32324/76 and 51933/76; Japanese Patent Application (OPI) No. 15541/75; and U.S. Pat. Nos. 3,672,904 and 3,801,321.

Further, when phenylenediamines are employed as a reducing agent, a color image can be produced by the combined use of a phenolic or an active methyleneic color coupler and a phenylenediamine, as disclosed in U.S. Pat. Nos. 3,531,286 and 3,764,328. Similarly, a color image can be obtained in accordance with the method disclosed in U.S. Pat. No. 3,761,270.

Of the above-described reducing agents, specific mono-, bis-, tris- or tetrakis-phenols which contain an aromatic nucleus to which a hydroxy group is attached and which is substituted with an alkyl group such as methyl, ethyl, propyl, isopropyl or butyl, or an acyl group in at least one position adjacent the hydroxy group substituted position; for example, a 2,6-di-t-butyl phenyl group, are especially preferable because of their high stability to light and therefore, hardly any color change due to light occurs when they are used.

Furthermore, reducing agents of the kind which readily undergo photolysis upon exposure to light or are rendered inert upon exposure to light are especially advantageous, since they are decomposed by indoor light when allowed to stand in a bright room after development to result in the loss of the reducing ability and therefore, not to cause a color change due to light, as disclosed in U.S. Pat. No. 3,827,889. Specific examples of photolytic reducing agents include ascorbic acid or the derivatives thereof, furoin, benzoin, dihydroxyacetone, glycerin aldehyde, tetrahydroxyquinone rhodizonate, 4-methoxy-1-naphthol and aromatic polysulfur compounds as disclosed in Japanese Patent Application (OPI) No. 99719/75. Moreover, a positive image can be directly obtained when heat developable light sensitive materials prepared by taking advantage of reducing agents capable of being photolytically decomposed are subjected to image-wise exposure, since reducing agents present in the non-image area are decomposed by light and no coloration can subsequently result, as disclosed in U.S. Pat. Nos. 3,827,889 and 3,756,829. As disclosed therein compounds capable of accelerating the photolysis of the reducing agent can also be incorporated simultaneously in the material.

The reducing agent which is suitable for use is chosen by appropriately taking into account the kind (the extent of oxidizing power) of organic silver salt (component (a)) which will be used in combination therewith. For example, silver salts which are rather difficult to reduce, such as silver salts of benzotriazoles, silver behenate, etc., should be combined with rather strong reducing agents and silver salts which are rather readily reduced, such as silver caprate, silver laurate, etc., should be combined with rather weak reducing agents. Reducing agents suitable for silver salts of benzotriazoles include 1-phenyl-3-pyrazolidones, monocarboxylic acid esters of ascorbic acid, naphthols such as 4-methoxy-1-naphthols, etc., and so on. Reducing agents suitable for silver behenate include various kinds of compounds such as obisphenols of the bis(hydroxyphenyl)methane system, hydroquinones and so on. Reducing agents suitable for silver caprate and silver laurate include substituted tetrakisphenols, obisphenols of the bis(hydroxyphenyl)alkane system, p-bisphenols such as substituted bisphenol-A, etc., p-phenylphenol and so on. The most simple procedure for one skilled in the art to choose the preferred combination of a specific organic silver salt and a specific reducing agent is as follows; a light sensitive material is prepared using procedures similar to those employed in the examples described hereinafter. The superiority or the inferiority of the reducing agent used is evaluated from the photographic characteristics which the resulting material exhibits.

The suitable amount of the reducing agent used may fluctuate widely depending on the kind of organic silver salt used, the kind of reducing agent used and other additives present in the light sensitive material. However, an effective amount of the reducing agent generally ranges from about 0.05 mole to about 10 mole and preferably, from about 0.1 mole to about 3 mole, per mole of organic silver salt.

The above-described reducing agents may be used individually or in combination, as desired.

One of the preferred embodiments of the present invention is a heat-developable light-sensitive material containing a thiosulfonic acid compound in addition to the the above described components (a) to (e). Japanese Patent Application (OPI) No. 78227/51 (corresponding to U.S. Patent Application Ser. No. 644,685, filed Dec. 29, 1975) discloses that a thiosulfonic acid compound can be used as an anti-heat-foggant in heat-developable light-sensitive materials. A thiosulfonic acid compound is, however, much more markedly effective in the heat-developable light-sensitive material of the present invention as compared with other conventional anti-heat-foggants (e.g., as hereinbelow set forth). That is to say, a synergistic effect is obtained with a thiosulfonic acid compound with components (d) and (e), which effect cannot be obtained with other anti-heat-foggants. This synergistic effect is so high that it is completely unexpected from the effect obtained by incorporating a thiosulfonic acid compound in a heat-developable light-sensitive material containing only one of components (d) and (e). This fact will be clear from comparison of Sample A with Sample U or W in the Examples given hereinafter.

Preferred examples of thiosulfonic acid compounds which can preferably be employed in the present invention are compounds represented by the following general formula;

$$R_{12}SO_2SM_3$$

wherein $R_{12}$ represents a substituted or un-substituted aliphatic residue or a substituted or un-substituted aryl group, and $M_3$ represents a cation, other than a hydrogen ion. Preferred examples of $R_{12}$ include alkyl groups having 22 or less carbon atoms, or substituted alkyl groups in which the alkyl moiety has 22 or less carbon atoms, and which are substituted by an alkoxy group having 1 to 8 carbon atoms, or by an aryl group having 6 to 18 carbon atoms; and aryl groups having 6 to 30 carbon atoms, or substituted aryl groups in which the aryl moiety has 6 to 30 carbon atoms, and which are substituted by an alkyl group having 1 to 8 carbon atoms, by an aralkyl group having 7 to 14 carbon atoms or by an aryl group having 6 to 18 carbon atoms.

Specific examples of thiosulfonic acid compounds include sodium n-octylthiosulfonate, potassium n-dodecylthiosulfonate, potassium n-tetradecylthiosulfonate, sodium benzyl thiosulfonate, sodium n-undecylthiosulfonate, potassium n-tetradecylthiosulfonate, lithium benzylthiosulfonate, potassium n-hexadecylthiosulfonate, potassium 2-ethoxyethylthiosulfonate, sodium benzenethiosulfonate, lithium benzenethiosulfonate, potassium benzenethiosulfonate, sodium p-toluenethiosulfonate, potassium p-methoxybenzenethiosulfonate, potassium p-ethoxybenzenethiosulfonate, sodium 2-naphthylthiosulfonate, potassium 3-t-butylbenzenethiosulfonate, sodium 3,4-dimethylbenzenethiosulfonate, potassium 3-chlorobenzenethiosulfonate, sodium 4-nitrobenzenethiosulfonate or potassium 3-acetylbenzenethiosulfonate and son on. These thiosulfonic acid compounds can be used individually or as a combination thereof.

These thiosulfonic acid compounds are effectively used in an amount within the range of about $10^{-5}$ to about 1 mole and more particularly, $6 \times 10^{-4}$ to $10^{-1}$ mole, per mole of the organic silver salt. The addition of the thiosulfonate compounds in an amount less than the above-described lower limit does not result in sufficient thermal fog-prevention effects for the heat developable light sensitive material of the present invention, while addition of an amount in excess of the above described amount inhibits the progress of development to result in a reduction in the maximum density of the image obtained.

The heat-developable light-sensitive material of the present invention can, needless to say, contain a conventional anti-heat-foggant in combination with or in place of a thiosulfonic acid compound.

Examples of conventional anti-heat-foggants are, for example, a mercury compound such as mercury bromide and mercury acetate as disclosed in U.S. Pat. No. 3,589,903; 2-thiouracils as disclosed in U.S. Pat. No. 4,002,429; N-halocompounds as disclosed in U.S. Pat. Nos. 4,003,749 and 4,009,039; and the specific particular compounds as disclosed in U.S. Pat. No. 3,885,968; Japanese Patent Application (OPI) Nos. 101019/75, 116024/75, 123331/75, 134421/75 and 22431/76; and Japanese Patent Application OPI Nos. 47419/76, 42529/76, 51323/76, 57435/76, 104338/76 and 24520/77; for example, lithium salts, peroxides, rhodium salts, cobalt salts, palladium compounds, cerium compounds, fatty acids or the salts thereof, sulfinic acid or the salts thereof, disulfides, rosins, polymer acids and so on.

A wide variety of known methods may be applied to the heat developable light sensitive material of the present invention with the intention of preventing a color change due to light from occurring after the completion of the processings (which means that undesirable coloration appears gradually in the non-exposed areas when the light sensitive material already photographically processed is allowed to stand as it is exposed to normal room illumination).

For this purpose, for example, precursors of stabilizing agents such as azole thioethers and blocked azole thiones, as disclosed in U.S. Pat. No. 3,839,041; terazolylthio compounds as disclosed in U.S. Pat. No. 3,700,457; light sensitive halogen-containing organic oxidizing agents as disclosed in U.S. Pat. No. 3,707,377; halogen-containing compounds as disclosed in Japanese Patent Application (OPI) 119624/75 and U.S. Pat. No. 3,874,946; 1-carbamoyl-2-tetrazolic-5-thiones as disclosed in U.S. Pat. No. 3,893,859; simple substance sulfur as disclosed in Japanese Patent Application (OPI) No. 26019/76; and so on may be added to the heat developable light sensitive materials of the present invention.

Each of the components which can be employed in the present invention is dispersed into at least one kind of colloid capable of acting as a binder. Advantageous binders are, in general, hydrophobic binders, but hydrophilic binders may be used for this purpose. These binders should be transparent or translucent. Examples of suitable binders, include proteins such as gelatin, polysaccharides such as dextran, natural materials such as gum arabic, and other synthetic polymers. Preferred binders are described in Japanese Patent Application (OPI) No. 22431/76. Especially preferred examples of binders include polyvinyl butyral, polyvinyl acetate, ethylcellulose, polymethylmethacrylate, cellulose acetate butyrate, gelatin and polyvinyl alcohol. These binders may be optionally, used as a combination thereof. A preferred weight ratio of the amount of the binder to that of the organic silver salt component (a) ranges from about 10:1 to about 1:10 and particularly, about 4:1 to about 1:4.

The layers which contain the components essential to the heat developable light sensitive material of the present invention, and other layers may be coated on a support selected from a wide variety of support materials. The support material may have any shape, but in general, a film-form, a sheet-form, a roll-form or a ribbon-form support is preferably empolyed, because it is preferred for the support to be flexible from the standpoint of handling. Examples of suitable materials for the support include synthetic resin films, synthetic resin sheets, glass, wool, cotton cloth, paper, metals such as aluminum, and so on. Specific examples of synthetic resin films include cellulose acetate film, polyester films, such as polyethyleneterephthalate films, polyamide films, polyimide films, triacetate films, polycarbonate films and so on. Specific examples of paper which can be used as a support include commonly used paper, photographic raw paper, paper for printing such as coated paper, art paper or the like, baryta paper, resin-coated paper, water proof paper, paper sized using a polysaccharide or the like, as disclosed in Belgian Pat. No. 784,615; pigment paper containing titanium dioxide or the like, paper coated with an α-olefin polymer (e.g., polyethylene, polypropylene, a ethylene-butene copolymer, etc.), paper pretreated with polyvinyl alcohol, and so on.

The heat developable light sensitive material of the present invention can contain additionally an anti-static layer, an electrically conductive layer, an evaporated thin metallic layer, a subbing layer and a backing layer.

In addition, a top coat layer can be, optionally, provided on a light sensitive layer with the intention of increasing the transparency of the heat developable light sensitive layer and improving the heat resistance of the light sensitive layer. A suitable thickness of the top coat polymer layer ranges from about 1 micron to about 20 microns. Preferred polymers employed for forming the top coat polymer layer include polyvinyl chloride, a vinyl chloride-vinylidene chloride copolymer, polyvinyl acetate, a vinyl chloride-vinyl acetate copolymer, polystyrene, methylcellulose, ethylcellulose, cellulose acetate butyrate, cellulose acetate, vinylidene chloride, polycarbonate, gelatin, polyvinyl alcohol and so on.

Material such as titanium dioxide, kaolin, zinc oxide, silica, alumina, polysaccharides including starch and the like, and so on may be incorporated into the above-described top coat polymer layer, which makes it possible to write thereon with stamp pad ink, a ball-point pen or a pencil.

Anti-halation materials, anti-halation dyes, whiteness-increasing dyes, filter dyes, light-absorbing materials, fluorescent whiteness-increasing agents, plasticizers, lubricants, surface active agents, hardeners and other known additives employable in conventional silver halide light sensitive materials can be, optionally, employed. In the heat developable light sensitive material of the present invention. In addition, matting agents such as potassium carbonate, starch, titanium dioxide, zinc oxide, silica, dextrin, barium sulfate, aluminum oxide, clay, diatomaceous earth, kaolin, etc., may be, optionally, present in the heat developable light sensitive material of the present invention.

A composition for forming a light sensitive layer is coated on a support at a coverage of about 0.2 g to about 3 g and preferably, about 0.3 g to about 2 g, of silver, from both the silver contained in the organic silver salt and the silver halide, per square meter. A coating of the light sensitive composition at a coverage less than the above-described lower limit results in a reduction in the maximum density of the image obtained, while a coating at a coverage more than the upper limit gives rise to no practical increase in image density and increases the cost.

Specifically, the procedures for preparing the heat developable light sensitive materials of the present invention are illustrated schematically below. Namely, an organic silver salt-forming agent is reacted with a silver ion-donating agent (e.g., silver nitrate) using one of the various methods previously described to produce the organic silver salt (a). The preparation is usually carried out at atmospheric pressure and at a temperature of about −15° C to about 80° C and preferably, about 20° C to 60° C. The resulting organic silver salt is washed and rinsed with water, an alcohol (e.g., methanol, ethanol, isopropanol etc.) or the like and then, dispersed into a suitable binder for making an emulsion. Upon dispersion, a colloid mill, a mixer, a ball mill or the like may be used. The dispersion is usually carried out at ordinary temperature (about 15° C to about 25° C). A silver halide-forming agent is added to the thus obtained polymer dispersion of the silver salt to result in a conversion of some of the organic silver salt into the corresponding silver halide. An appropriate temperature for the above-described conversion reaction ranges from ordinary temperature to about 80° C, and the reaction time suitable for the above-described conversion may be arbitrarily chosen within the range of about 1 second to 48 hours. As previously described, silver halides which have already been prepared may be added to the above-described polymer dispersion, or silver halides and the organic silver salt may be prepared at the same time. Next, sensitizing dyes, reducing agents, color toning agents and other appropriate additives are added to the resulting polymer dispersion in that order and preferably, in a form of solution. Usually, they are added successively to the polymer dispersion with stirring at a temperature ranging from ordinary temperature to about 50° C with an appropriate time interval (usually 5 to 20 min) between each additive addition. The thus prepared coating solution is coated on a suitable support. In a similar manner to the formation of the heat developable light sensitive layer using the above-described procedures, coating solutions empolyed for the top-coat polymer layer, a subbing layer, a backing layer and other layers, respectively, are prepared. They are coated in turn using various coating techniques such as a dip coating, air knife coating, curtain coating or hopper coating technique. Two or more layers can be, optionally, coated at the same time, as disclosed in U.S. Pat. No. 2,761,791 and British Pat. No. 837,095.

Optionally, the surface of a support, the back of the support or the coated layer on a support can be printed on. As a result, the heat developable light sensitive material of the present invention can be employed as a (season) ticket, a post card or other documents having a prescribed pattern thereon.

The thus prepared heat developable light sensitive material is cut into strips or a like shape having an appropriate size, and then, imagewise-exposed. Heat is, optionally, preliminary applied to the sensitive material before exposure (to maintain the temperature of the sensitive material at about 80° C to about 140° C). Light sources suitable for imagewise-exposure, include a tungsten lamp, a fluorescent lamp for copying which is mainly used for the exposure of diazo sensitive materials, a mercury lamp, halogen lamp, a xenon lamp, a CRT light source, a laser light source and so on. As originals, not only drawings but also photographic images with gradation may be used. In addition, it is possible to use the light-sensitive material of the invention to take a photograph of a person or a landscape using a camera. For the purpose of printing, a contact printing technique, a reflex printing technique or an enlargement printing technique may be employed. Although the exposure amount depends upon the sensitivity of the light-sensitive material used, about 10 lux·sec and about $10^4$ lux·sec are, in general, required for high sensitive materials and for low sensitive materials, respectively. The imagewise-exposed sensitive material can be developed simply by heating (up to a temperature ranging from about 80° C to about 180° C and preferably, from about 100° C to about 150° C). The time required for heating can be controlled arbitrarily within a range of 1 second to 60 seconds. The heating time depends upon the heating temperature. Usually, the following conditions are suitable: at 120° C for about 5 seconds to about 40 seconds, at 130° C for about 2 seconds to about 20 seconds, at 140° C for about 1 second to about 10 seconds, and so on. Various heating means can be employed in the present invention. For example, the sensitive material is contacted with a simple heated plate or a heated drum, or is passed through a heated space. Furthermore, the material can be heated using high frequency waves or a laser beam, as disclosed in U.S. Pat. No. 3,811,885. The odor generated from the sensitive material upon heating can be prevented by using a processing machine equipped with deordorants. Alternatively, a certain type of perfume can be incorporated into the heat developable light sensitive material so that the odor is not perceived by the nose, as disclosed in Japanese Patent Application OPI No. 10925/76.

In accordance with the present invention, heat developable light sensitive materials which provide images of a pure black tone, which do not cause a contamination with phthalazinones which occurs conventionally in a developing device when development is repeated a large number of times, which possess photographic characteristics which are unharmed upon storage for a long time under high humidity, and which have the advantage that the heat development speed is high can be produced.

The present invention is now illustrated in greater detail by reference to the following examples. Unless otherwise indicated herein, all parts, percentages, ratios, and the like are by weight.

EXAMPLE 1

34 g of behenic acid was mixed with 500 ml of water and warmed to 85° C to dissolve the behenic acid in water. While the resulting aqueous solution of behenic acid was stirred at 1800 r.p.m., an aqueous solution of 2.0 g of sodium hydroxide and 50 ml of water (at 25° C) was added thereto over a 3 minute period. Thus, a mixture of sodium behenate and behenic acid was produced. With stirring at 1800 r.p.m., the mixture was cooled to 30° C.

Next, while further stirring the resulting mixture, an aqueous solution of silver nitrate (at 25° C) which was prepared from 8.5 g of silver nitrate and 50 ml of water was added thereto over a 3 minute period. Then, the stirring was additionally continued for 90 minutes. 200 ml of isoamyl acetate was added thereto and the resulting silver behenate precipitate was collected, dispersed into an isopropanol solution of polyvinyl butyral (comprising 25 g of Denka Butyral 4000-2 produced by Electro Chemical Industry Co., Ltd. and 200 ml of isopropanol) using a homogenizer (25° C, 3000 r.p.m. 30 min) to prepare a polymer dispersion of silver behenate.

Next, to the polymer dispersion of silver behenate maintained at a temperature of 50° C with stirring at 500 r.p.m., an acetone solution of N-bromosuccinimide (0.7 g of N-bromosuccinimide and 50 ml of acetone) (at 25° C) was added and then, the resultant mixture was stirred for 60 minutes. Thus, a polymer dispersion containing both silver bromide and silver behenate was obtained.

A portion comprising one-twelfth by weight of the thus obtained dispersion (1/240 mole) was weighed out, and the temperature of this dispersion was kept at 30° C. To this dispersion with stirring at 200 r.p.m., the following components were added in the order described below at a time interval of 5 min to prepare the Coating Solution (A).

| Component | |
|---|---|
| (1) Merocyanine Dye (sensitizing dye) (0.025% by weight methyl Cellosolve solution) | 2 ml |
| 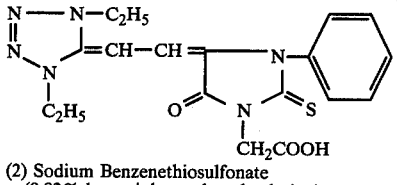 | |
| (2) Sodium Benzenethiosulfonate (0.02% by weight methanol solution) | 4 ml |
| (3) 4-Hydroxymethylphthalazinone (component (d)) (3% by weight methyl Cellosolve solution) | 9 ml |
| (4) Benzoxazinedione (component (e)) (1% by weight methyl Cellosolve solution) | 2 ml |
| (5) o-Bisphenol (reducing agent) (10% by weight acetone solution) | 10 ml |
| 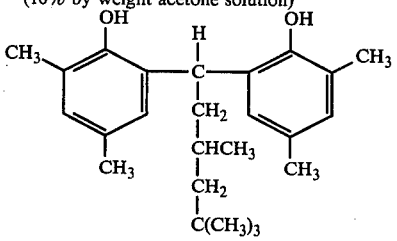 | |

On the other hand, for the purpose of comparison Coating Solution B was prepared in the same manner as Coating Solution A except that 4-hydroxymethylphthalazinone, component (3) described above, was not used.

Further for the purpose of comparison, Coating Solution C was prepared in the same manner as Coating Solution A except that benzoxazinedione component (4) described above, was not employed.

For the purpose of an additional comparison, Coating Solution D was prepared in the same manner as Coating Solution A except that hydroxymethylphthalazinone, component (3) described above, and benzoxazinedione, component (4) described above were not added thereto.

Each of the thus prepared 4 coating solutions was coated on a support (pressure sensitive raw paper on which polyvinyl alcohol had been coated) at a coverage of 0.3 g of silver per square meter. The thus obtained Heat Developable Light Sensitive Materials (A), (B), (C) and (D) each was wedgewise-exposed using light from a tungsten light source (maximum exposure amount: 3000 CMS). Then, they were developed by heating at 130° C for 8 seconds by contact with a heated plate.

In addition to the above-processed samples, each of Heat Developable Light Sensitive Materials (A), (B), (C) and (D) was allowed to stand for 5 days under the conditions of a temperature of 35° C and a relative humidity of 80% (this procedure is described hereinafter as "forced deterioration test"). After the conclusion of this procedure, these materials were exposed and heat-developed under the same conditions described above.

The photographic characteristics were evaluated by determining the reflection density of each sample. The results obtained are shown in Table 1 below.

Table 1

| Sample No. | Component (e)/(d) Molar Ratio | Before Forced Deterioration | | | After Forced Deterioration | | |
|---|---|---|---|---|---|---|---|
| | | Fog | $D_{max}$ | R.S.* | Fog | $D_{max}$ | R.S.* |
| A | 0.08:1 | 0.11 | 1.38 | 350 | 0.13 | 1.18 | 292 |
| B | Only (e) | 0.10 | 0.15 | — | 0.14 | 0.16 | — |
| C | Only (d) | 0.11 | 0.55 | 100 | 0.12 | 0.23 | 16 |
| D | None | 0.03 | 0.03 | — | 0.05 | 0.05 | — |

*Relative sensitivity when the sensitivity of Sample (C) before forced deteioration test was assumed to be 100. The sensitivity is represented by the reciprocal of the logarithm of the amount of exposure necessary to attain an optical density of fog + 0.1 (hereinafter the same).

It can be seen from the results in Table 1 that a slight decrease in sensitivity by forced deterioration occured with Heat Developable Light Sensitive Material (A) and therefore, this light sensitive material exhibited excellent shelf-life, compared with Heat Developable Light Sensitive Material (C) which contained as a color toning agent only 4-hydroxymethylphthalazinone. A practical sensitivity could not obtained for Heat Developable Light Sensitive Material (B) containing as a color toning agent only benzoxazinedione, and Heat Developable Light Sensitive Material (D) not containing any color toning agents.

EXAMPLE 2 to 5

Heat Developable Light Sensitive Materials (E), (F), (G) and (H) were prepared in the same manner as in Example 1 except that the following compounds were employed instead of 4-hydroxymethylphthalazinone or benzoxazinedione: Namely, 5 ml of a 4% by weight methyl Cellosolve solution of phthalazinone was used instead of 4-hydroxymethylphthalazinone, and 6-bromo-benzoxazinedione sodium salt, 7-methylbenzoxazinedione, oxazinedione or quinazolinedione was employed in the amount described in Table 2-a below instead of benzoxazinedione.

On the other hand, Heat Developable Light Sensitive Materials (I), (J), (K) and (L) were prepared in the same manner as Heat Developable Light Sensitive Materials (E), (F), (G) and (H), respectively, except that phthalazinone was not added thereto.

In addition, Heat Developable Light Sensitive Material (M) was prepared in the same manner as Heat Developable Light Sensitive Material (C) except that 5 ml of a 4% by weight methyl Cellosolve solution of phthalazinone was used instead of 4-hydroxymethylphthalazinone added to Coating Solution (C) in Example 1.

The above-described Heat Developable Light Sensitive Materials (E), (F), (G), (H), (I), (J), (K), (L) and (M) were exposed and heat-developed in the same manner as in Example 1, and after forced deterioration, they were also exposed and heat-developed in the same manner as in Example 1. The photographic characteristics of these samples were examined. The results obtained are shown in Table 2-b below.

Table 2-a

| Run No. | Sample No. | Amount of Phthalazinone Used as Component(d) (0.4% by weight of methyl-Cellosolve solution) | Component (e) and Amount Used |
|---|---|---|---|
| 2 | E | 5 ml | 6-Bromobenzoxazinedione (0.3% by weight of methyl Cellosolve solution) 6 ml |
| | I | — | |
| 3 | F | 5 ml | 7-Methylbenzoxazinedione (0.5% by weight of methyl Cellosolve solution) 8 ml |
| | J | — | |
| 4 | G | 5 ml | Benzoaxazinedione (0.5% by weight of methyl Cellosolve solution) 6 ml |
| | K | — | |
| 5 | H | 5 ml | Quinazolinedione (0.5% by weight of methyl Cellosolve solution) 5 ml |
| | L | — | |
| Control | M | 5 ml | — |

Table 2-b

| Run No. | Sample No. | Component (e)/(d) Molar Ration | Before Forced Deterioration Fog | $D_{max}$ | R.S.* | After Forced Deterioration Fog | $D_{max}$ | R.S.* |
|---|---|---|---|---|---|---|---|---|
| 2 | E | 0.05:1 | 0.11 | 1.32 | 105 | 0.14 | 1.21 | 89 |
| | I | — | 0.12 | 0.15 | — | 0.12 | 0.14 | — |
| 3 | F | 0.16:1 | 0.11 | 1.35 | 108 | 0.14 | 1.25 | 92 |
| | J | — | 0.11 | 0.14 | — | 0.12 | 0.14 | — |
| 4 | G | 0.12:1 | 0.12 | 1.34 | 110 | 0.13 | 1.24 | 90 |
| | K | — | 0.12 | 0.17 | — | 0.14 | 0.16 | — |
| 5 | H | 0.11:1 | 0.11 | 1.35 | 104 | 0.11 | 1.18 | 85 |
| | L | — | 0.10 | 0.12 | — | 0.10 | 0.11 | — |
| Control | M | — | 0.12 | 1.33 | 100 | 0.14 | 0.44 | 25 |

*Relative sensitivity when the sensitivity of Sample (M) before forced deterioration was assumed to be 100.

It can be seen from the results in Table 2-b above that Heat Developable Light Sensitive Materials (E), (F), (G) and (H) of the present invention possess much superior shelf life, as compared with Heat Developable Light Sensitive Material (M) wherein phthalazinone was used alone, and Heat Developable Light Sensitive Materials (I), (J), (K) and (L) wherein benzoxazinediones or quinazolinediones were used alone.

EXAMPLE 6

Heat Developable Light Sensitive Material (N) was prepared and processed in the same manner as in Example 1 except for the following differences: (1). Use of 7 ml of a 3% by weight methyl Cellosolve solution of 4-methylphthalazinone instead of 4-hydroxymethylphthalazinone, and (2) the use of 8 ml of a 1% by weight methyl Cellosolve solution of benzoxazinedione instead of 2 ml thereof.

On the other hand, for the purposes of comparison, Heat Developable Light Sensitive Material (O) was prepared in the same manner as Heat Developable Light Sensitive Material (N) except that 4-methylphthalazinone was not added thereto.

For additional comparison, Heat Developable Light Sensitive Material (P) was prepared in the same manner as Heat Developable Light Sensitive Material (N) except that benzoxazinedione was not added thereto.

The above-described Heat Developable Light Sensitive Materials (N), (O) and (P) were processed in the same manner as in Example 1. The results obtained are shown in Table 3 below.

Table 3

| Sample No. | Component (e)/(d) Molar Ratio | Before Forced Deterioration Fog | $D_{max}$ | R.S.* | After Forced Deterioration Fog | $D_{max}$ | R.S.* |
|---|---|---|---|---|---|---|---|
| N | 0.38:1 | 0.11 | 1.18 | 450 | 0.13 | 1.08 | 360 |
| O | Only (e) | 0.12 | 0.18 | — | 0.12 | 0.17 | — |
| P | Only (d) | 0.10 | 0.25 | 100 | 0.13 | 0.18 | — |

*Relative sensitivity when the sensitivity of Sample (P) before forced deterioration was assumed to be 100.

It can be seen from the results in Table 3 that Heat Developable Light Sensitive Material (O) which contained only component (e), and Heat Developable Light Sensitive Material (P) which contained only Component (d) could not, in practice, provide an image because of the small value of $D_{max}$, compared with their fog density, and that, they were markedly desensitized in the forced deterioration. On the other hand, it can be also seen from the results in Table 3 that Heat Developable Light Sensitive Material (N) not only provided a good image because the value of $D_{max}$ was sufficiently large, compared with the fog density, but also kept a practically efficient sensitivity even after forced deterioration and exhibited an excellent shelf-life.

EXAMPLE 7

A large number of sheets (100 sheets) of Heat Developable Light Sensitive Material (A) prepared as in Example 1, and the same number of sheets of Heat Developable Light Sensitive Material (M) prepared as in Example 2 to 5, each were heat-developed in turn using a technique wherein a sheet was passed through the space present between a silicone rubber roller and a heated shoe which was heated to 125° C and then, allowed to come into contact with the silicone rubber roller, with a time of 3.5 seconds being taken for each development procedure.

When Heat Developable Light Sensitive Material (M) was developed, it was found that white powders adhered to the metallic parts of the processing device used. The adhered powders were confirmed to be phthalazinone as the result of analysis.

On the other hand, no deposit of white powders such as that above-described was observed when Heat Developable Light Sensitive Material (A) was developed.

It can be seen from the above-described results that the developing device used was not contaminated with the color toning agent contained in Heat Developable Light Sensitive Material (A) and that, this material provided an image of high density.

Comparison Example 1

Heat Developable Light Sensitive Material (Q) was prepared in the same manner as Heat Developable Light Sensitive Material (A) in Example 1 except that 12.5 ml of a 2% by weight methyl Cellosolve solution of benzoxazinedione was used instead of the use of 2 ml thereof.

In addition, Heat Developable Light Sensitive Material (R) was prepared in the same manner as Heat Developable Light Sensitive Material (A) in Example 1 except that, instead of 9 ml of a 3% by weight methyl Cellosolve solution of 4-hydroxymethylphthalazinone, 0.8 ml of the same solution was used and that, 12.5 ml of a 2% by weight methyl Cellosolve solution of benzoxazinedione was used instead of 2 ml of the same solution and further, 8 ml of methyl Cellosolve was added thereto.

Furthermore, Heat Developable Light Sensitive Material (S) was prepared in the same manner as in Example 1 except that 10.5 ml of methyl Cellosolve was additionally added to Coating Solution (A) prepared in Example 1.

These Heat Developable Light Sensitive Materials (Q), (R) and (S) were processed in the same manner as in Example 1. The results obtained are shown in Table 4 below.

Table 4

| Sample No. | Component (e)/(d) Molar Ratio | Before Forced Deterioration | | | After Forced Deterioration | | |
|---|---|---|---|---|---|---|---|
| | | Fog | $D_{max}$ | R.S.* | Fog | $D_{max}$ | R.S.* |
| Q | 1:1 | 0.28 | 1.38 | 95 | 0.35 | 1.19 | 85 |
| R | 11.3:1 | 0.11 | 0.58 | 38 | 0.12 | 0.36 | 12 |
| S | 0.08:1 | 0.12 | 1.36 | 100 | 0.13 | 1.17 | 95 |

*Relative sensitivity when the sensitivity of Sample (S) before forced deterioration was assumed to be 100.

From the results given in Table 4, the following conclusions can be drawn: Namely, about 10.5% desensitization occurred due to the forced deterioration in Heat Developable Light Sensitive Material (Q) having a component (e)/(d) molar ratio of 1:1 (i.e., containing both benzoxazinedione and 4-hydroxymethylphthalazinone in an equi-molar amount), and about 68.4% desensitization occurred due to the forced deterioration in Heat Developable Light Sensitive Material (R) having a component (e)/(d) molar ratio of 11.3:1. On the other hand, in Heat Developable Light Sensitive Material (S) having a component (e)/(d) molar ratio of 0.08:1, desensitization could be controlled to about 5%. In addition, the fog which occurred in Heat Developable Light Sensitive Material (S) was less than that in Heat Developable Light Sensitive Material (Q). Therefore, Heat Developable Light Sensitive Material (S) had superior shelf-life than Heat Developable Light Sensitive Materials (Q) and (R). From these results, it was proved that the shelf-life of the heat developable light sensitive materials changed drastically to the worse when the component (e)/(d) ratio value was over 1:1; that is to say, excellent shelf-life could be attained only within a component (e)/(d) ratio less than about 1.

Comparison Example 2

Heat Developable Light Sensitive Material (T) was prepared in the same manner as in Example 1 except for the following differences: Namely, in Coating Solution (A) of Example 1, (1) a dispersion of 1.83 g of benzoxazinedione dispersed in 11 ml of methyl Cellosolve was used instead of 2 ml of a 1% by weight methyl Cellosolve solution of benzoxazinedione, (2) 4-hydroxymethylphthalazinone was added thereto, (3) 4 ml of a 0.17% by weight methanol solution of mercury acetate was used instead of sodium benzenethiosulfonate and (4) 10 ml of a 18% by weight acetone solution of bis(2-hydroxy-3-tert-butyl-5-methylphenyl) methane was used as a reducing agent.

In addition, Heat Developable Light Sensitive Material (U) was prepared in the same manner as Heat Developable Light Sensitive Material (T) except that 4 ml of a 0.01% by weight methanol solution of sodium benzenethiosulfonate was used instead of the above-described mercury acetate.

Further, Heat Developable Light Sensitive Materials (V) and (W) were prepared in the same manner as Heat Developable Light Sensitive Materials (T) and (U), respectively, except that the reducing agent was added in an amount of 10 ml of a 10% by weight acetone solution.

These heat developable light sensitive materials were processed in the same manner as in Example 1. The results obtained are shown in Table 5 below.

Table 5

| Sample No. | Anti-fog gant | Concentration of Reducing Agent | Before Forced Deterioration | | | After Forced Deterioration | | |
|---|---|---|---|---|---|---|---|---|
| | | | Fog | $D_{max}$ | R.S.* | Fog | $D_{max}$ | R.S.* |
| T | Mercury Acetate | 18% (by weight) | 0.28 | 1.08 | 200 | 0.32 | 0.98 | 160 |
| U | Sodium Benzenethiosulfonate | " | 0.56 | 1.06 | — | 0.66 | 1.01 | — |
| V | Mercury Acetate | 10% (by weight) | 0.13 | 0.56 | 85 | 0.14 | 0.49 | 65 |
| W | Sodium Benzenethiosulfonate | " | 0.18 | 0.58 | 87 | 0.20 | 0.50 | 70 |

*Relative sensitivity when the sensitivity of Heat Developable Light Sensitive Material (C) before forced deterioration in Example 1 was assumed to be 100.

From the results shown in Table 5, it was found that fog occurred markedly in Heat Developable Light Sensitive Material (U) wherein benzoxazinedione was added in an effective amount as a toning agent according to the conventional technique, and a toxic mercury compound was required for the purpose of the prevention of fog (as in Heat Developable Light Sensitive Material (T)), while when the amount of reducing agent was reduced with the intention of preventing fog from occurring, the value of $D_{max}$ necessary to be observed as an image of sufficient density could not achieved.

EXAMPLE 8

The color of the image obtained with each of the above-described Heat Developable Light Sensitive Materials (A) to (W) prepared in Examples 1 to 6 and in Comparison Examples 1 and 2 was determined. The results obtained are shown in Table 6.

Table 6

| Sample No. | Before Forced Deterioration | After Forced Deterioration |
|---|---|---|
| A | Black | Black |
| B | Yellowish-brown | Yellowish-brown |
| C | Blackish-brown | Brown |
| D | No Coloration | No Coloration |
| E | Black | Black |
| F | " | " |
| G | " | " |
| H | " | " |
| I | Yellowish-brown | Yellowish-brown |
| J | " | " |
| K | " | " |
| L | " | " |
| M | " | " |

Table 6-continued

| Sample No. | Before Forced Deterioration | After Forced Deterioration |
|---|---|---|
| N | Black | Black |
| O | Brown | Brown |
| P | Yellowish-brown | Yellowish-brown |
| Q | Black | Black |
| R | Brown | Brown |
| S | Black | Black |
| T | Blackish-brown | Brown |
| U | Blackish-brown | " |
| V | Brown | " |
| W | " | " |

It can be seen from the results in Table 6 that Heat Developable Light Sensitive Materials (A), (E), (F), (G), (H), (N) and (S) which were prepared in accordance with preferred embodiments of the present invention exhibited a preferred black color tone, while Heat Developable Light Sensitive Materials (B), (C), (D), (I), (J), (K), (L), (M), (O), (P), (T), (U), (V) and (W) wherein phthalazinones alone, benzoxazinediones alone or quinazolinediones alone were employed as a color toning agent did not exhibit the preferred black tone, but exhibited an unsatisfactory yellowish-brown or brown color tone. In addition, it was also found that although Heat Developable Light Sensitive Material (Q) having a component (e)/(d) molar ratio of 1:1 could produce an image of a black tone, the other photographic characteristics of this material were undesirable as shown in Table 4, and Heat Developable Light Sensitive Material (R) having a component (e)/(d) molar ration of 11.3:1 produced an image of brown tone and therefore, Heat Developable Light Sensitive Material (R) was undesirable with respect to not only color tone but also other photographic characteristics.

While the invention has been described in detail and with reference to specific embodiments thereof, it will be apparent to one skilled in the art that various changes and modifications can be made therein without departing from the spirit and scope thereof.

What is claimed is:

1. A heat developable light sensitive material which comprises a support having therein or in one or more layers thereon (a) an organic silver salt, (b) a light sensitive silver halide or a component capable of producing a light sensitive silver halide and (c) a reducing agent and additionally containing (d) at least one phthalazinone and (e) at least one compound selected from benzoxazinediones and quinazolinediones; in a molar ratio of the amount of component (e) to that of component (d) less than about 0.2;1 but greater than 0 in at least one layer of said layers containing components (a) to (c), in a specific layer additionally provided on the support other than said layers containing components (a) to (c), or in the support.

2. The heat developable light sensitive material of claim 1, wherein said molar ratio of the amount of component (e) to that of component (d) ranges from 0.001:1 to 0.2:1.

3. The heat developable light sensitive material of claim 1, wherein said molar ratio of the amount of component (e) to that of component (d) ranges from 0.01:1 to 0.2:1.

4. The heat developable light sensitive material of claim 1, wherein a thuosulfonic acid compound is additionally present as an anti-foggant wherein said thiosulfonic acid compound is represented by the general formula $$R_{12}SO_2SM_3$$

wherein $R_{12}$ is an aliphatic group or an aromatic group, and $M_3$ is a cation other than a hydrogen ion.

5. The heat-developable light sensitive material of claim 1, wherein said phthalazinone (d) has the general formula

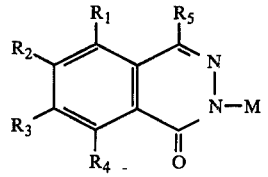

(I)

wherein $R_1$, $R_2$, $R_3$, $R_4$ and $R_5$, which may be the same or different, each represents a hydrogen atom, a halogen atom, a hydroxy group, a nitro group, a $—NH_2$ group or a carbon-containing group containing 1 to 20 carbon atoms, which may additionally contain one or more of an oxygen atom, a nitrogen atom, a sulfur atom, and a halogen atom; and M represents a hydrogen atom, a univalent metal atom, a hydroxyalkyl group or a carbamoyl group having an organic substituent group containing 1 to 18 carbon atoms; and said benzoxazinedione and said quinazolinedinone (e) is represented by the general formula (II)

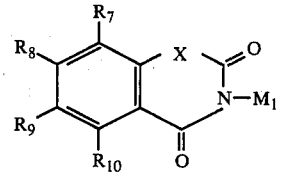

(II)

wherein $R_7$, $R_8$, $R_9$ and $R_{10}$, which may be the same or different, each represents a hydrogen atom, a halogen atom, a hydroxy group, a nitro group, a $—NH_2$ group or a carbon-containing group containing 1 to 20 carbon atoms which may additionally contain one or more of an oxygen atom, a nitrogen atom, a sulfur atom and a halogen atom; X represents an oxygen atom or a $<N-R_{11}$ group, where $R_{11}$ represents a carbon-containing group containing 1 to 20 carbon atoms which may additionally contain one or more of an oxygen atom, a nitrogen atom, a sulfur atom and a halogen atom; and wherein $R_7$ and $R_8$, $R_8$ and $R_9$, or $R_9$ and $R_{10}$ may further combine and form an aromatic ring; and $M_1$ represents a hydrogen atom, a hydroxymethyl group or a univalent metal atom.

6. The heat developable light-sensitive material of claim 5, wherein said carbon-containing group represented by $R_1$, $R_2$, $R_3$, $R_4$ or $R_5$ is an alkyl group containing 1 to 4 carbon atoms, a haloalkyl group containing 1 to 4 carbon atoms, a hydroxyalkyl group containing 1 to 4 carbon atoms, an alkoxy group containing 1 to 4 carbon atoms, an aryl group which may be substituted with one or more of an alkyl group containing 1 to 4 carbon atoms or a halogen atom, an aralkyl group containing 7 to 12 carbon atoms, an acyl group containing 2 to 4 carbon atoms, an alkenyl group containing 3 to 6 carbon atoms, a morpholinosubstituted alkyl group containing 1 to 4 carbon atoms in the alkyl moiety thereof, a 2-substituted vinyl group, an aminoalkyl group containing 1 to 4 carbon atoms in the alkyl moiety, a dialkyl amino group containing 1 to 4 carbon atoms in each of the alkyl moieties thereof or a dialkyl aminoalkyl group having 1 to 4 carbon atoms in each of the alkyl moieties thereof; said univalent metal atom represented by M is a lithium atom, a sodium atom, a potassium atom or a silver atom; said hydroxyalkyl group for M has 1 to 5 carbon atoms, and said carbamoyl group represented by M is represented by the following formula $$\left[ -\overset{\overset{\displaystyle O}{\|}}{C}-NHR_6 \right]$$

wherein $R_6$ represents a carbon-containing group containing 1 to 18 carbon atoms which may additionally contain one or more of an oxygen atom, a nitrogen atom, a sulfur atom or a halogen atom.

7. The heat-developable light-sensitive material of claim 6, wherein $R_6$ is an alkyl group containing 1 to 18 carbon atoms; an alkoxyalkyl group containing 1 to 12 carbon atoms in the alkyl moiety thereof and 1 to 4 carbon atoms in the alkoxy moiety thereof; an alkenyl group containing 3 to 6 carbon atoms; or an aryl group which may be substituted with one or more of an alkyl group containing 1 to 4 carbon atoms, an alkoxy group containing 1 to 4 carbon atoms, an acyl group, a halogen atom, and an aryl group.

8. The heat-developable light-sensitive material of claim 6, wherein the carbon-containing group represented by $R_7$, $R_8$, $R_9$, $R_{10}$ and $R_{11}$ is an alkyl group containing 1 to 4 carbon atoms; a haloalkyl group containing 1 to 4 carbon atoms; a hydroxyalkyl group containing 1 to 4 carbon atoms; and alkoxy group containing 1 to 4 carbon atoms; a cycloalkyl group containing 5 to 12 carbon atoms; and alkylamino group containing 1 to 4 carbon atoms in the alkyl moiety thereof, an acyl group containing 2 to 4 carbon atoms; an alkenyl group containing 3 to 6 carbon atoms; or an alkylthio group containing 1 to 4 carbon atoms; and the univalent metal atom for $M_1$ is a lithium atom, a sodium atom, a potassium atom, a rubidium atom or a cesium atom.

9. The heat-developable light-sensitive material of claim 4, wherein said thiosulfonic acid compound is sodium n-octylthiosulfonate, potassium n-dodecylthiosulfonate, potassium n-dodecylthiosulfonate, sodium benzylthiosulfonate, sodium n-undecylthiosulfonate, potassium n-tetradecylthiosulfonate, lithium benzylthiosulfonate, potassium n-hexadecylthiosulfonate, potassium 2-ethoxyethylthiosulfonate, sodium benzenethiosulfonate, lithium benzenethiosulfonate, potassium benzenethiosulfonate, sodium p-toluenethiosulfonate, potassium p-methoxybenzenethiosulfonate, potassium p-ethoxybenzenethiosulfonate, sodium 2-napthylthiosulfonate, potassium 3-t-butylbenzenethiosulfonate, sodium 3,4-dimethylbenzenethiosulfonate, potassium 3-chlorobenzenethiosulfonate, sodium 4-nitrobenzenethiosulfonate, or potassium 3-acetylbenzenethiosulfonate.

10. The heat-developable light-sensitive material of claim 4, wherein said thiosulfonic acid compound is present in amount of about $10^{-5}$ to about 1 mole per mole of said organic silver salt (a).

11. The heat-developable light-sensitive material of claim 6, wherein at least one of $R_7$, $R_8$, $R_9$ and $R_{10}$ is a halogen atom.

* * * * *